United States Patent [19]

Schiller

[11] 4,422,245

[45] Dec. 27, 1983

[54] TRIPOD OPEN THROAT T-SQUARE AND DRAFTING BOARD

[76] Inventor: Saul Schiller, 1709 Ave. I, Brooklyn, N.Y. 11230

[21] Appl. No.: 149,711

[22] Filed: May 14, 1980

Related U.S. Application Data

[63] Continuation-in-part of Ser. No. 28,198, Apr. 9, 1979, abandoned.

[51] Int. Cl.[3] ..... B43L 13/02

[52] U.S. Cl. ..... 33/403; 33/42

[58] Field of Search ..... 33/42, 41, 1 B, 1 N, 33/403, 430–447, 32 R, 32 B, 32 C

[56] References Cited

U.S. PATENT DOCUMENTS

| | | | |
|---|---|---|---|
| 29,767 | 8/1860 | Chisholm | 33/424 |
| 346,836 | 8/1886 | Almorth | 33/468 |
| 611,697 | 10/1898 | Lundy | 33/437 |
| 634,836 | 10/1899 | Rich | 33/430 |
| 1,031,665 | 7/1912 | Packington | 33/437 |
| 1,145,922 | 7/1915 | Rigaumont | 33/42 |
| 1,356,971 | 10/1920 | Cnare | 33/443 |
| 1,581,937 | 4/1926 | Leishman | 33/403 X |
| 2,660,802 | 12/1953 | Keys | 33/42 X |
| 2,874,474 | 2/1959 | Beebe et al. | 33/430 |
| 2,899,749 | 8/1959 | McWhirter et al. | 33/403 |
| 2,936,470 | 5/1960 | Meeds | 33/42 |
| 3,357,037 | 12/1967 | Kaplan | 33/41 R X |
| 3,430,347 | 3/1969 | Minniear | 33/27 C |
| 4,138,819 | 2/1979 | Sosin | 33/426 |

FOREIGN PATENT DOCUMENTS

| | | | |
|---|---|---|---|
| 2289877 | 5/1976 | France | 33/419 |

*Primary Examiner*—Harry N. Haroian
*Attorney, Agent, or Firm*—William T. Hough

[57] ABSTRACT

In a preferred embodiment, there is provided a drafting board having x and y axes and of a predetermined size for a specifically desirable paper size, the drafting board having indicia in juxtaposition to and following each edge of the x and y axes and the bottom edge of the drafting board being of a width sufficient to support two spaced-apart roller surfaces of a T-square to be positioned on the drafting board, the bottom edge's width extending laterally across the board's bottom as a planar surface, and a T-square having a straight edge along a first longitudinal axis that extends from bottom to top of the board when placed thereon, and the T-square having a helve head unitary with a proximal end of the blade, and the helve head having a second longitudinal axis extending substantially at a right angle to the straight edge and extending substantially parallel to the board's bottom edge and to the planar surface of the board's bottom edge, and structure of the helve head along the second longitudinal axis carrying three seprate and spaced-apart roller surfaces arranged in tripod triangular arrangement positioned to each roll laterally along the planar surface of the board's bottom edge such that when the T-square is mounted on the drafting board and concurrently the roller surface positioned against the planar surface, the straight edge is held stably against vertical and lateral shifting relative to the board's upper face, and an indexed open-throat of the T-square provides for accurate reading of position with regard to positioning of the straight edge laterally to and from left and right.

4 Claims, 4 Drawing Figures

Fig. 1
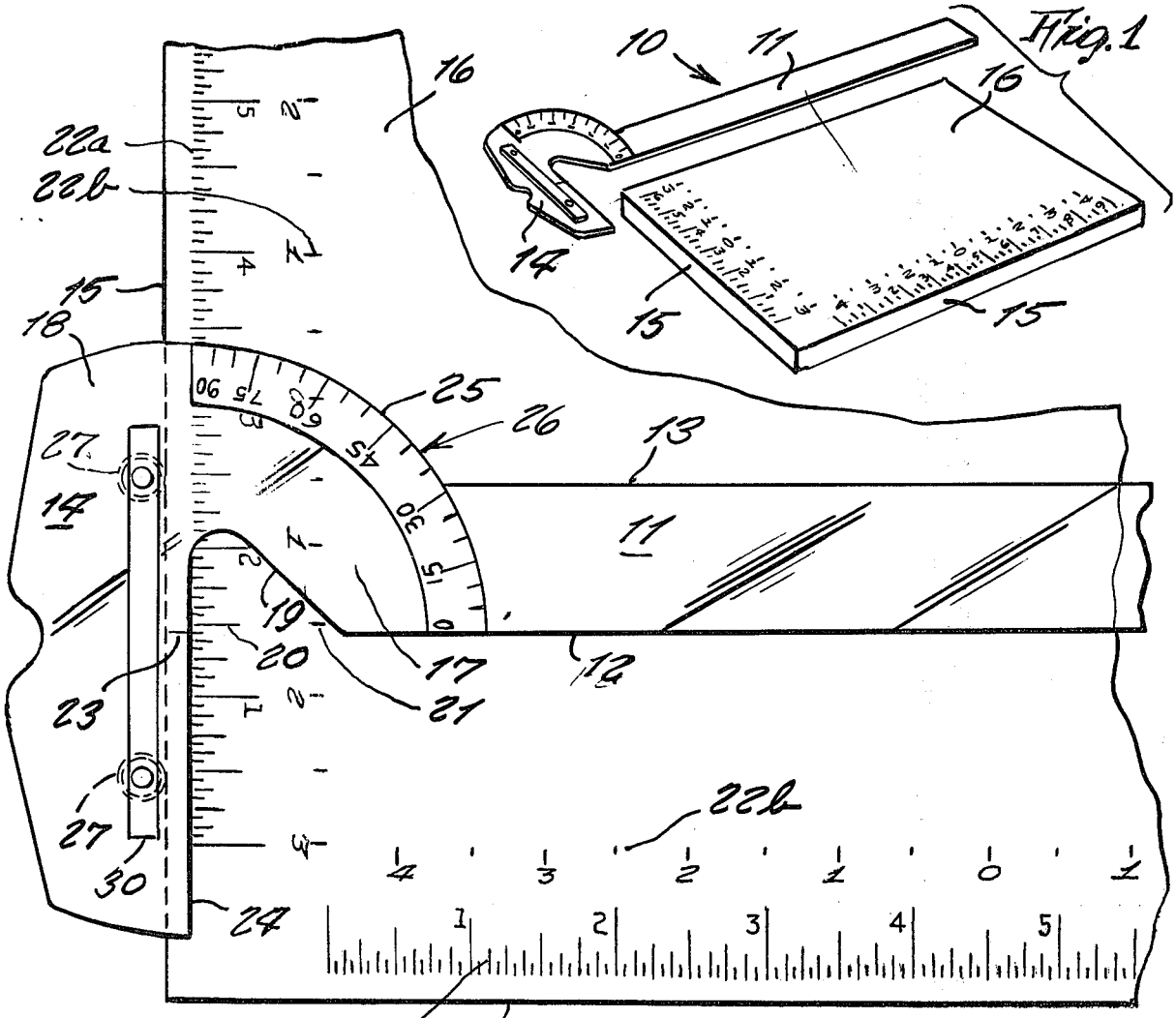
Fig. 2
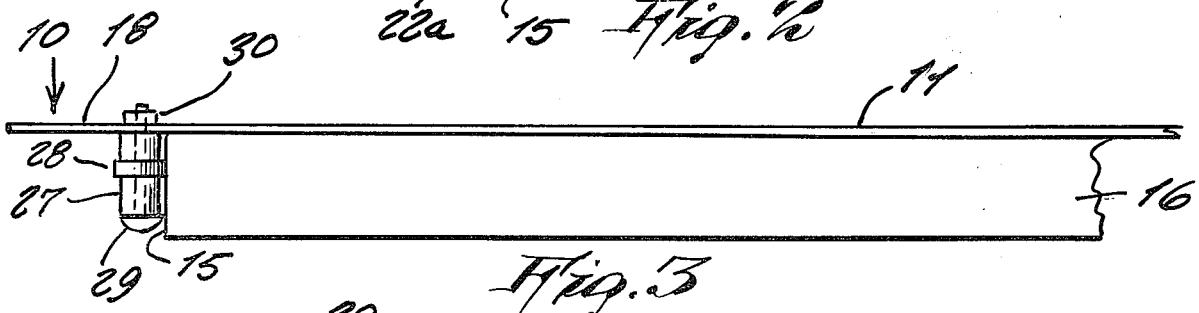
Fig. 3
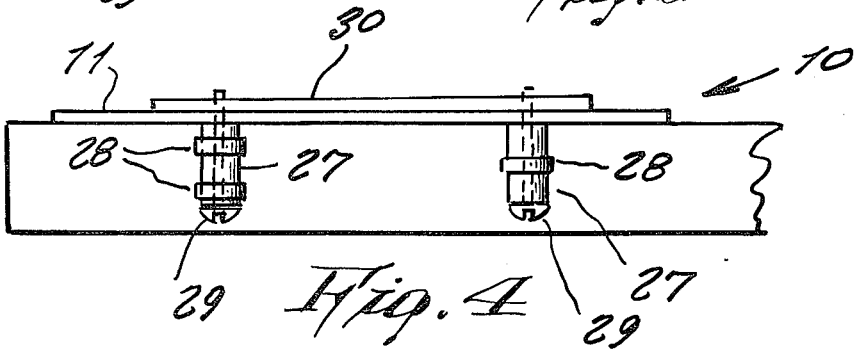
Fig. 4

TRIPOD OPEN THROAT T-SQUARE AND DRAFTING BOARD

This is a continuation-in-part of U.S. Ser. No. 028,198 filed Apr. 9, 1979, now abandoned and relates to an improved T-square and a combination thereof with a drafting board.

It is well known to those acquainted with the art, that a conventional T-square consists of a straight-edge inclusive of a long blade, and having a helve head at a lower end thereof. The helve head includes a crosspiece extending laterally along a longitudinal axis at a right-angle to the straight edge. Such construction can be prevented from rocking or wobbling vertically—with regard to the straight-edge relative to the upper face of the drafting board—by normally the pressure of the individual draftsman's hand-finger(s); rocking or wobbling is normally experienced as a result of the board's surface or paper's surface being curved, slanted or crooked, a frequent occurance. Also, the conventional T-square has the limitation of not allowing a person to see a scale calibration and alignment identifiable on the drawing board edge for alignment with an index line formed by a lower edge of the T-square crosspiece.

The U.S. Pat. No. 2,874,474 to K. H. Beebe et al. is the sole patent applied against the parent application Ser. No. 028,198 above-noted of the present inventor, and that patent does not relate to the problem of the straight-edge rocking or wobbling vertically or upwardly away from the drafting board's upper face; to the contrary, this patent requires an uprightly-oriented rail 16 along which horizontally oriented rollers have surfaces clamped against opposite upright faces of the rail. The rail is mounted onto the bottom edge of a drafting board. Accordingly, the sole motion that is thereby controlled is that the straight-edge is held against pivoting laterally between left and right along the surface (upper face) of the drafting board and the paper mounted thereon. Nothing in the structure disclosed in the Beebe patent relates to rocking nor wobbling of the straight-edge upwardly away from the upper surface of the drafting board.

With regard to an open-throated T-square, the previously applied U.S. Pat. No. 1,581,937 of Le Roy J. Leishman discloses an open-throated T-square of which the sole mechanism for alignment with an index line is the edge-itself of the straight-edge. It is not possible to accurately nor swiftly ascertain the exact reading thereby, nor is such point of cut-back to the open throat configuration specifically identifiable as to which exact specific point at and around the point of turning-the-corner does or does not constitute the "reading" point. At best, it would be difficult to make a reasonably accurate reading.

SUMMARY OF THE INVENTION

Objects of the present invention include the overcoming or avoiding of problems and difficulties of the types discussed-above, together with the achieving of novel results.

Another object, more particularly, is to avoid the rocking or wobbling of the straight-edge upwardly-away from the upper surface of the drafting board or the paper mounted thereon, devoid of the former requirement of a draftsman applying pressure by his hand and/or finger(s) in order to assure that the straight-edge is held flushly against the above-noted upper-surface of the drafting board.

Another object, more particularly, is to obtain a novel T-square incorporating the non-rocking non-wobbling feature.

Another object is to obtain a novel combination of such T-square and a drafting board, devoid of structures that could get in the way of the working-movements of the draftsman, such as the rail mounted on the board's lower surface shown in the above-noted Beebe et al. patent.

Another object is to obtain a novel open-throated T-square of improved design and structure providing for speedy and accurate readings of scaled indicia on the drafting board's upper face.

Another object is to obtain a novel T-square having an integral helve-head's crosspiece carrying roller structures arranged to achieve above-noted objects of non-rocking and non-wobbling.

Another object of the invention is that of obtaining an open-throated T-square that concurrently permits ready-indexing and which does not hide the scale carried on the drafting board.

Another object is to obtain a T-square and drafting board combination which concurrently avoids shifting of the straight edge both laterally and upwardly, relative to an upper face of the drafting board or paper mounted thereon.

Another object is to obtain a T-square of improved mobility devoid of clinging of the lower face of a straight-edge to an upper face of a drafting board or paper mounted thereon.

Other objects become apparent from the preceding and following disclosure.

One or more of preceding objects are obtained by the invention as disclosed herein as illustrated in the accompanying drawings intended to improve understanding of the invention, but not to unduly limit its scope which includes other variations and modifications thereof that are within ordinary skill of the artisan in this particular field.

Accordingly, the invention may be broadly described as a T-square of which the helve head is unitary (i.e. integral) with the straight edge, and of which the helve head's cross-piece extends at a right angle to the straight edge's first longitudinal axis, the cross-piece extending along a second longitudinal axis and having in tri-pod fashion or arrangement three spaced-apart roller surfaces mounted thereon positioned to roll against an upright edge surface of a drafting board. At least two of the roller surfaces are arranged or positioned substantially extending along the second longitudinal axis of the cross-piece, and at least two of the roller surfaces are arranged or positioned relative to one-another to be substantially transverse to that second longitudinal axis, such that a tri-pod or triangular relationship exists between the respective ones of the three roller surfaces. All roller surfaces are positioned to roll solely laterally, permitting the helve head to shift or be shifted alternately left and right as desired, as the roller surfaces are held pressed against the upright edge surface of the drafting board. By virtue of this arrangement, a three-point support is provided against shifting in any direction, when the three roller surfaces are maintained concurrently in contact pressed against the side or edge face of the drafting board. For the first time, there is thereby provided support against the straight-edge rocking upwardly away from the upper surface of the drafting board or paper mounted thereon, by virtue of the three-point stance by which the cross-piece is supportable against the edge of the drafting board. The unitary rigid union between the cross-piece and the straight edge provides this sturdy support from the helve head to the straight edge. Likewise there is concurrently provided support against lateral shifting, i.e. pivoting, of the straight edge, because of the supporting tri-pod arrangement of the roller surfaces.

The accuracy of work and reading of indicia on the drafting board are further enhanced by virtue of the tripod support against any and all shifting and rocking, when the roller surfaces are maintained in pressed-contact with the above-noted edge face of the drafting board. In accord therewith, it thereby becomes further possible for the draftsman to work more precisely if other more accurate mechanism for reading the indicia scale is provided. Heretofore, because of the difficulties of rocking and other shifting of the straight edge, it was somewhat immaterial whether or not the reading was precise; however, with the non-shifting tripod feature of this invention, precise reading of the scale becomes much more critical, allowing the draftsman to work with a much higher degree of precision. Accordingly, there is a preferred embodiment of the invention, in which first of all, the straight edge and helve head provide for an open-throat arrangement allowing improved viewing of the indicia on both sides of what should be the point of reading; but additionally, there is provided for the first time in conjunction with an open-throat a fixed-point index reading line aligned with the edge of the straight-edge, with the fixed-point index reading line being positioned to coincide with the index indicia positioned on the face of the drafting board, but with the indicia being not hidden by the open-throated structure, using the board in combination.

By virtue of the tri-pod support offered by the T-square of the present invention, a significant degree of support is afforded in lifting-slightly—in the sense of off-setting a part of the weight of the straight-edge that normally drags across the upper face of the drafting board frictionally; the novel T-square of this invention reduces thereby the sliding friction and concurrently prevents wobbling, when positioning the T-square by way of finger pressure against the T-square to press the tri-pod roller surfaces against the above-noted edge face or side of the drafting board used in combination.

By use of the novel index-line and open-throat arrangement described above, a draftsman is now able to scribe a line from any index or scale registration without resorting to dots or pin pricks for positioning a straight edge of conventional prior design.

It should be noted, that as in the illustrated design, the spaced-apart roller surfaces may have two of such surfaces mounted on a common roller hub, the equivalent of separate hubs each with a separate roller surface.

The invention may be better understood by making reference to the following Figures.

THE FIGURES

FIG. 1 is a perspective view of the drawing board and T-square.

FIG. 2 is an enlarged detail thereof, with T-square placed on the drawing board, illustrating the larger inventive combination, in operation, in a top view thereof.

FIG. 3 is a front edge view thereof.

FIG. 4 is a left edge view thereof.

DETAILED DESCRIPTION

Referring now to the drawing in greater detail, the reference numeral 10 represents an open throat T-square, according to the present invention wherein there is a long flat, straight blade 11 having parallel opposite straight edges 12 and 13. At one end of the blade there is a head 14 formed integrally therewith and which serves as a helve head for sliding the T-square manually along a side edge 15 of a drafting table or board 16. The T-square is cut or stamped as a single part from a flat panel of metal hard plastic, or the like.

Instead of being T-shaped at the junction of the blade and helve with a right angle construction of the blade meeting with a center of the helve, the blade of the present invention has an angular bend 17 at its end so to junction with one end 18 of the helve, thus resulting in an open throat or light 19 wherein there is accordingly a complete exposure to view of those indicia calibrations 20 and 21 (of scales **22*a* and 22*b* provided on the drawing board, as a greater combination of this invention) and which ever happen to align with the lower straight edge 12 of the blade, and a mark 23 scribed on the helve edge 24 so to align with the straight edge 12. The helve edge 24 aligns with the seale 22*a*. The index mark 23 is in absolute exact alignment with the straight-edge straight-surface 12**, providing an exact specific index mark reading point—eliminating any guess-work while having the advantage concurrently of the open throat view of the surrounding index calibrations above-noted.

The outward edge 25 of the bend 17 is circularly curved so to form a protractor 26 of 90 degrees length by having calibrations scribed on the blade as far as the lower straight edge 12, the arc of the protractor curve being struck at a point of the mark 23 so that the protractor calibration "zero" is along edge 12.

In the present invention, the helve is fitted with a pair of spaced apart rollers 27 for rolling along the edge 15 of the drawing board 16, so that the sliding action of the T-square is more friction-free than that of a conventional T-square. The rollers are fitted with rubber rings 28 of larger diameter than the rollers in order to engage the edge 15. The rollers are mounted rotatably free on screws 29 extending through the metal or plastic helve and which are threaded in holes of a metal bar 30 riveted or otherwise stationarily affixed upon an upper side of the helve.

It may be readily seen that one roller (hub) 27 has mounted thereon two separate and spaced-apart roller surfaces 28, and that a third 27 is spaced further along a longitudinal axis of the blade (straight-edge) having a single roller surface thereon, thus forming the previously described tri-pod arrangement, with the three separate roller surfaces traveling along three separate paths in the same direction but at different elevations on the edge 15, producing a triangular tri-pod support preventing wobbling and rocking and shifting of the straight edge. It should be noted that the metal bar is mounted on the cross-piece which is at right angles to the straight-edge.

In use, the T-square can be slid on either edges of the drawing board. The drawing paper is taped down edge to edge along the centering scales (3-0-3; 41/2-0-4 1/2) on board 16. The lines are scribed against straight edge 12. Two intersecting lines meet at a point whose locusis inside the area bounded by the horizontal and vertical scales **22*a*. The draftsman makes a direct reading on the coordinates of this point by observing the index line 23** as registered on the X, Y scales. Via a corollary technique. The draftman scribes a line directly from any index scale registration without resorting to dots or pin pricks for positioning the straight edge.

It is to be understood that many other novel and useful functions may be obtained by use of this invention and that various apparent modification and improvements and substitution of equivalents and variations are within the scope of the invention to the extent within ordinary skill in this art.

What is conventionally termed x and y axes of the board correspond respectively to the FIG. 2 left scale and FIG. 2 horizontally-shown bottom scale. Each board edge extending uprightly adjacent the respective scale, is a roller-supporting surface of the board along which the tri-pod arrangement of roller surfaces may travel when pressed thereagainst and moved laterally relative thereto.

I claim:

1. A scribing T-square comprising a blade having a straight edge along a first longitudinal axis of the blade, and a helve head unitary and rigidly connected with a proximal end of the blade, said helve head having a second longitudinal axis extending substantially at a right angle to said straight edge, and three spaced-apart rollers mounted in triangular relationship to one-another on said helve head at different locations of which each roller at at-least two locations relative to each other are substantially aligned along said second longitudinal axis and of which at at-least two locations relative to each other are substantially aligned in a direction substantially transverse to each of said first and second longitudinal axes such that a tripod support arrangement of the three spaced-apart rollers is formed, the three spaced-apart rollers being mounted on axes extending at substantially right angles to said first and second longitudinal axes such that support by said tripod support arrangement of rollers is preventative of wobbling of said helve head and said blade relative to a scribing board's upper surface during use of the scribing T-square when said three spaced-apart rollers are positioned on a first upright edge of a scribing board.

2. A scribing T-square of claim 1, including in combination a drafting board having said upper surface and having said first upright edge and having a series of indicia calibrations along an x axis in juxtaposition to said first upright edge on said upper surface of the drafting board and having a series of indicia calibrations along a y axis in juxtaposition to a lateral edge of said upper surface of the drafting board, and having a second upright edge extending along the y axis, said first and second upright edges being substantially transverse to one-another and each being adapted to be rolled upon at different times by the three spaced-apart rollers in the tripod support arrangement when pressed thereagainst.

3. A scribing T-square of claim 2, including an open-throat shape at a point of junction of the helve head with the blade, and the helve head carrying a legibly visible index mark adjacent a space formed by an open-throat shape, spaced across-from a lower end of said straight edge and aligned therewith.

4. A scribing T-square of claim 1, including an open-throat shape at a point of junction of the helve head, and the helve head carrying a legibly visible index mark adjacent a space formed by an open-throat shape, spaced across-from a lower end of said straight edge and aligned therewith.

* * * * *